US005394786A

United States Patent [19]

Gettle et al.

[11] Patent Number: 5,394,786

[45] Date of Patent: * Mar. 7, 1995

[54] ACOUSTIC/SHOCK WAVE ATTENUATING ASSEMBLY

[75] Inventors: Guy L. Gettle, Walnut Creek, Calif.; Vincent H. Homer, Jr., Jeddeh, Saudi Arabia

[73] Assignee: Suppression Systems Engineering Corp., Santa Clara, Calif.

[ * ] Notice: The portion of the term of this patent subsequent to Jun. 6, 2010 has been disclaimed.

[21] Appl. No.: 81,998

[22] Filed: Jun. 30, 1993

Related U.S. Application Data

[63] Continuation-in-part of Ser. No. 834,411, Feb. 12, 1992, Pat. No. 5,225,622, which is a continuation-in-part of Ser. No. 541,030, Jun. 19, 1990, abandoned.

[51] Int. Cl.[6] ..... F42B 33/00

[52] U.S. Cl. ..... 86/50; 367/191; 181/286; 181/0.5; 89/36.02; 102/303

[58] Field of Search ..... 86/50; 367/191; 181/286, 0.5; 89/36.02; 102/303

[56] References Cited

U.S. PATENT DOCUMENTS

| | | | |
|---|---|---|---|
| 4,454,798 | 6/1984 | Shea et al. | 181/223 |
| 4,543,872 | 10/1985 | Graham et al. | 86/50 |
| 4,589,341 | 5/1986 | Clark et al. | 102/303 |
| 4,836,939 | 6/1989 | Hendrickson | 252/3 |
| 4,903,573 | 2/1990 | Browne et al. | 86/50 |
| 4,964,329 | 10/1990 | Moxon et al. | 86/50 |
| 5,225,622 | 7/1993 | Gettle et al. | 86/50 |

OTHER PUBLICATIONS

Walters, W. P., *Fundamentals of Shaped-Charges*, John Wiley & Sons, Inc. (1989), pp. 13–14.

Fricke, J., "Aerogels", *Scientific American*, vol. 258, No. 5, May 1988, pp. 92–97.

*Primary Examiner*—J. Woodrow Eldred

*Attorney, Agent, or Firm*—John A. Bucher

[57] ABSTRACT

An acoustic/shock wave attenuating assembly comprised of porous screens forms an enclosure filled with a suitable pressure wave attenuating medium or material having fluid characteristics. This basic configuration can be suspended or held in place by a rigid structure. When the pressure attenuating medium is a liquid, the attenuating assembly is provided with a lining for containment. Multiple attenuating assemblies can be employed, with adjacent attenuating assemblies separated by a small gap. The pressure attenuating medium may be a liquid, a gas emulsion, an aqueous foam, or a gel (with or without entrained gas). Alternatively, solid particulates having bulk mechanical properties of a fluid may be employed as the pressure wave attenuating medium and may have an adhesive or the like resisting relative movement between particulates to simulate viscous effects. Elements of the assembly may incorporate materials which absorb thermal energy through endothermic chemical reactions, such as intumescent materials, to enhance the pressure attenuating effect.

31 Claims, 6 Drawing Sheets

ACOUSTIC/SHOCK WAVE ATTENUATING ASSEMBLY

This is a continuation-in-part of application Ser. No. 07/834,411, filed Feb. 12, 1992, and issuing on Jul. 6, 1993, as U.S. Pat. No. 5,225,622, that application in turn being a continuation-in-part of application Ser. No. 07/541,030, filed Jun. 19, 1990, now abandoned.

FIELD OF THE INVENTION

This invention relates to pressure wave phenomena (acoustic and shock waves) and more specifically to an assembly for providing attenuation of pressure waves traveling generally at or above the speed of sound in ambient conditions in order to mitigate undesirable effects of these waves (including fragments and thermal energy release).

BACKGROUND OF THE INVENTION

Acoustic and shock waves are traveling pressure fluctuations which cause local compression of the material through which they move. Acoustic waves cause disturbances whose gradients, or rates of displacement are small—on the scale of the displacement itself. Acoustic waves travel at a speed determined by and characteristic of a given medium; thus, one must speak of the speed of sound, or acoustic speed in that medium. An acoustic wave regardless of its frequency (pitch) or amplitude (loudness), will always travel at the same speed in a given substance.

Shock waves are distinguished from acoustic waves in two key respects. First, shock waves travel faster than the speed of sound in any medium. Secondly, local displacements of atoms or molecules comprising a medium caused by shock waves are much larger than for acoustic waves. Together, these two factors produce gradients or rates of their displacement much larger than the local fluctuations themselves.

Energy is required to produce pressure waves. This is related to the equation that states that energy equals force multiplied by the displacement caused by the force. Once the driving source ceases to produce pressure disturbances, the waves decay. Attenuation involves acceleration of the natural damping process, which therefore means removing energy from pressure waves.

All matter through which pressure waves travel naturally attenuates these waves by virtue of their inherent mass. Materials possess different acoustic attenuating properties, strongly affected by density and by the presence or absence of phase boundaries and structural discontinuities. Porous solid materials, thus, are better attenuators of sound waves than perfect crystalline solids. Gases are inherently poor pressure wave attenuators.

All types of pressure waves can be reflected and diffracted by liquid and gas media. They can also be deflected or, more generally, scattered and dispersed by phase boundaries, such as liquid droplets or solid particulates suspended in air. These deflections serve to increase the distance which the wave travels. Scattering and dispersion thus produce more attenuation because they cause the transmitting pressure waves to displace more mass by virtue of the longer path. Such deflections also reduce, or may altogether eliminate the pressure waves originally traveling in a specific direction.

Acoustic Wave Attenuation

Documented efforts to reduce noise (attenuate acoustic waves) in enclosed spaces extend to the early nineteenth century. Virtually all acoustic wave attenuation concepts have been based upon layers of solid materials with significant sound absorbing properties serving as linings, coatings, or loosely-packed fibrous or granular fillers between solid layers. These sound-absorptive layers have been applied to or incorporated within structural walls, floors, ceilings, and other types of panels and partitions when acoustic attenuation is required. Several dozen patents have been granted in the United States alone which fall into this category.

In 1910, Mallock introduced the idea of using aqueous foams for noise suppression, and conducted experimental evaluation of foams in this role. See Mallock, A., "The damping of sound by frothy liquids", *Proc. Royal Soc.* A84; pp. 391–5, 1910. Aqueous foams are agglomerations of bubbles, with the gas phase within each bubble completely separated from that in adjacent bubbles by aqueous liquid film comprising the bubble walls. During the years following Mallock's research, aqueous foams became widely used for fire suppression, in numerous chemical processes, and for mineral ore separation.

Not until the 1960's did interest renew in using aqueous foams for pressure wave attenuation. Research from that time and continuing to the present extended to their use for suppressing jet engine noise and acoustic disturbances arising from artillery muzzle blast, ordnance disposal, and "sonic boom" created by supersonic aircraft flight. It was during this time that researchers discovered that aqueous foams dramatically attenuate impinging shock waves.

Shock Wave Attenuation

Much more energy is required to produce shock waves compared to acoustic disturbances, which makes their attenuation more difficult. Shock waves decay to form acoustic waves when the source of the shock wave is removed or suppressed.

When traveling through gases, shock waves produce increases in pressure (often referred to as "overpressure") and temperature; they also accelerate gas molecules and entrained particulates in the direction of shock wave travel. Shock waves produced by combustion processes, such as explosions and deflagrations, release substantial amounts of thermal and radiant energy as well. For all shock waves, the shock wave speed, overpressure, and temperature increase they induce in the local medium are mathematically linked. Attenuation of shock waves is thus achieved through directly suppressing one of these three parameters; if temperature is reduced, the overpressure and shock speed are accordingly reduced, for example.

Mitigation of shock wave parameters has required different approaches than those used for acoustic wave attenuation because of their relatively large impulse and pressure magnitude. Mechanical mitigation methods can be applied in many situations where barriers or confinement are allowable. When shock waves are produced by explosions or deflagrations, chemical means as well can often be used for suppression. None of the structures or materials described in existing patents or in technical literature similar to the types of solid sandwich configurations discussed above for noise suppression can provide significant attenuation of shock waves.

Two types of structures or mechanical arrangements have been employed in reducing shock wave effects: solid barriers (including blast mats) and mechanical venting. Solid barriers and blast mats have been used to deflect incident shock waves or remove energy from incident waves through momentum transfer (to the high-inertia mats and barriers), and to provide protection from fragments and thermal effects. Mechanical venting has been employed to keep internal pressure below the level which would cause structural failure for explosions in confined spaces.

Solid barriers for shock wave containment or protection suffer from several shortcomings. Where protection of large areas from powerful shock effects is necessary, concrete or earthen barriers must be employed. These structures must be massive and are thus inherently immobile and expensive and time consuming to erect. They cannot, therefore, be used in the majority of applications where explosion hazards are present: marine transport of liquid and liquefied hydrocarbons, petrochemical storage and processing facilities, aboard warships and munition-carrying vessels, or at hastily established munitions transshipment points (which are common in military operations, for example). They cannot be used within buildings or otherwise serve as partitions in structures.

Similarly, large numbers of bulky and heavy blast mats are required for blast overpressure exceeding a 1-meter scaled distance (the equivalent blast wave intensity of a 1-kilogram TNT detonation at a distance of 1 meter). When not being used, these mats must be stored. Aboard ships, space is often critically limited, thus bulky items which provide no essential or alternate use cannot be justified. Furthermore, blast mats can at best provide only limited mitigation of blast effects in confined spaces and provide little acoustic damping. Their bulk, weight, and limited utility in confined spaces rule out their employment aboard aircraft. Blast mats cannot be easily or quickly moved from storage to locations where needed for blast wave attenuation due to their bulk and weight.

Mechanical venting is widely employed for mitigating blast overpressure in containment structures (grain silos, explosive material handling rooms, etc.) These vents normally constitute part of the containment wall. Besides reliability and response time problems, venting requires facilities to be designed such that overpressure release will not endanger personnel or nearby structures. Venting cannot be employed where hazardous materials may be released. Venting is also unacceptable aboard ships, where openings to the sea and release of smoke and overpressure within the vessel are dangerous. Mechanical venting cannot be used for noise attenuation.

Chemical agents suppress shock waves by extinguishing or interrupting the combustion process which generates them (along with their thermal effects). Such agents include carbon dioxide and halogenated carbon compounds ("halons"), which may either be gaseous or liquid initially at the time of application, and dry powders, most of which are salts of ammonium or alkali metals such as sodium and potassium.

Gaseous combustion-extinguishing agents are generally effective in confined spaces. A number of constraints limit their utility, however. No gaseous agent is effective in outdoor or well-ventilated areas. Within a confined space, effectiveness of gaseous agents is rapidly lost as these agents quickly escape through leaks and penetrations (including those caused by projectiles or weapons fragments which generate the need for gas agent release). All of the gas and liquid (which become gaseous in use) chemicals currently available for fire and explosion suppression have toxic effects upon humans at the concentrations required to be effective.

The most effective and least toxic gaseous agents are halogenated carbon compounds. However, these substances are quickly and irreversibly broken down while performing their combustion-inhibiting function. Furthermore, these agents are being withdrawn from use by international government agreements due to their profoundly adverse impacts upon upper-atmospheric ozone.

Other considerations limit the capabilities of gas fire-extinguishing agents. They cannot provide significant acoustic attenuation in and of themselves. Furthermore, gases cannot provide cooling or quenching of the area surrounding a fire or explosion due to their inherently low heat capacities, which enables hot surfaces to reignite combustible materials. Gas supplies must be adequate for extinguishment and be capable of reaching all spaces within a compartment, otherwise they have no effect. Gaseous explosion suppression systems are totally dependent upon sensors to initiate release (within 100 milliseconds), which has proven to be a problem because of false-alarm activation or failure to activate, due to the vulnerability of their sensors to dirt and contaminants. Sensors also require maintenance to ensure minimum reliability.

Powdered fire fighting agents (chemical extinguishants) can be effectively used in both confined and unconfined areas for fire suppression—and by virtue of their dissociation and combustion interrupting tendency—can suppress some deflagrations which could produce shock waves. Again, however, they cannot provide acoustic attenuation or fragment or missile-stopping capability. Furthermore, they require large quantities of agent (with consequent bulk and weight) to provide significant extinguishing capability. Flooding a space with powdered agents is blinding to personnel present during emergency operations.

Pressure Wave Attenuation Using Aqueous Foams

Aqueous foams have been proven to be capable of providing more pressure wave attenuation than any other medium on a mass basis. As noted above, initial research into the use of aqueous foams for pressure wave damping was entirely devoted to noise abatement. Subsequent research revealed, that—unlike any material used in acoustic attenuation structures developed to date—aqueous foams provide shock wave attenuation, regardless of the origin of the shock.

All applications to date of aqueous foams for pressure wave attenuation have been in two basic forms: unconfined deluge or massive foam flooding and employment of solid confining walls in which aqueous foam is placed. Massive deluge or high-capacity foam generation systems have been used for perimeter security and for flooding of buildings to provide explosion protection from bombs. Aqueous foam-filled containers have also been used for safe removal and disposal of explosives. Variants of the foam-filled container concept have been developed as noise-attenuation devices ("silencers") for the muzzles of firearms and large naval guns.

In spite of their successful application to date, current methods and systems for using aqueous foams in pressure attenuating roles are inefficient and unnecessarily bulky. Furthermore, such methods and systems prevent the full capabilities offered by aqueous foams from being realized because they require that the foam attenuate the incident shock or acoustic wave without mechanical augmentation or assistance. Solid walls utilized in current approaches are used only for fluid confinement and stopping fragments. Such usage requires much larger volumes of foam (foam agent and water) along with larger pumps and foam generating equipment than are necessary to provide a specified level of pressure wave attenuation.

Comparisons Between Solid and Aqueous Foams

Acoustic attenuation by both types of materials are comparable due to the fact that both rely upon scattering and dispersion of sound waves at bubble/cell walls. Solid foams are more compact, aqueous foams are more efficient on a mass basis. Major differences appear in regard to shock wave attenuation, however.

Solid materials, including solid foams, used as rigid panels are unable to attenuate shock waves because of two factors: the large amplitude of the displacements of atoms or molecules during shock wave propagation and the overpressure created in the surrounding fluid. Shock waves propagating through aqueous foams create turbulent flow fields, which have been shown to dissipate substantial amounts of energy, particularly when reflected waves travel through the turbulent medium See Khosla, A. "A study in shock wave attenuation", Ph.D. thesis, pp. 229–30, U. of Calgary, 1974. Turbulent flow fields cannot be generated within solid materials.

The relatively large displacement of the liquid mass contained within aqueous foam bubbles is resisted by surface tension and viscous forces, removing considerable shock wave energy as well. Again, such displacements cannot occur within solids, even elastomeric foams. Most shock wave energy encountering solid layers of any kind—including solid foams—is reflected, which produces overpressures exceeding the incident level. Furthermore, shock wave overpressures can knock down solid panels and walls without expending much energy.

Significant dissipation of shock wave energy can be accomplished with solid materials, according to the present invention as discussed further below, when the solid materials are used as loosely packed beads, in which form they are capable of relative displacement in the nature of a fluid. In such a form, the beads act similarly to bubbles in an aqueous foam. Specifically, transmitting shock waves are scattered and dispersed at the bead surfaces, and the displacement of the bead mass absorbs substantial energy. Substantially more shock wave energy can be absorbed when the beads are made to resist displacement to a limited extend (below the degree where the bead mass would act more as a rigid panel than a fluid). This can be accomplished by means of an adhesive surface coating or by a surface texture which promotes friction or adherence.

Experimental work has shown that volcanic foam glass (vermiculite) beads have been able to attenuate shock waves originating from small explosives comparable to the extent achieved by some aqueous foams. Vermiculite, however, provides less acoustic attenuation than solid organic foam materials such as natural rubber and polyurethane, which are normally used in this role. Furthermore, neither vermiculite nor any solid material used to date for acoustic attenuation has combustion extinguishing properties in and of itself; indeed, most organic solid foam materials are serious contributors to fire and toxic smoke generation.

Aqueous foams have additional mechanisms for dissipating shock energy which no solid bead material can provide: elastic bubble walls which absorb energy when they are deformed or ruptured, by uniquely and dramatically slowing shock waves propagating through, and—in the case of stronger shock waves—by causing these shock waves to separate into two separate waves, which are then more easily attenuated.

The references discussed above are incorporated herein as though set forth in their entirety, to facilitate understanding of the present invention, particularly in connection with the function and materials of aqueous foams.

SUMMARY OF THE INVENTION

In view of the shortcomings for existing apparatus and assemblies to attenuate acoustic and/or shock waves as noted above, there has been found to remain a need for an improved assembly for more effectively attenuating acoustic and/or shock waves. The present invention accordingly provides a means for attenuating substantially all types of pressure waves, existing as either an acoustic or shock wave, in generally all gaseous environments, particularly in ambient atmospheric conditions. More specifically, the invention provides a means or assembly for substantial suppression or attenuation of blast effects from either proximate or remote explosions as one of the more severe examples of pressure wave or acoustic/shock wave conditions effectively dealt with by the invention.

The term "acoustic level pressure condition" is employed herein to include both acoustic waves at the acoustic speed of a selected medium and/or shock waves exceeding the acoustic speed of a selected medium. Accordingly, that term is employed as a replacement for either or both conditions of acoustic waves and/or shock waves.

As discussed in greater detail elsewhere, the invention contemplates sonic/shock wave pressure conditions preferably traveling at or above the acoustic speed for a given medium. However, it will be apparent that the invention is also effective for pressure conditions generally approaching acoustic speeds in a given medium and thus exhibiting pressure characteristics to be desirably attenuated in the same manner as acoustic/-shock wave configurations.

In view of the above summary, the invention has a number of objects and advantages set forth as follows:

(a) to provide pressure wave attenuation capabilities in both confined spaces and unconfined areas;

(b) to provide attenuation of all acoustic frequencies regardless of orientation with respect to the source;

(c) to provide shock wave attenuation in confined spaces without requiring the space to be completely filled by aqueous foam or any other agent or medium;

(d) to provide attenuation of shock waves for both proximate and remote explosions;

(e) to provide a specified level of pressure wave attenuation in less volume and with lower weight than is possible through any other existing means;

(f) to provide shock wave attenuation in confined spaces without requiring the confining walls to be gas-tight (free from leaks or penetrations);

(g) to provide pressure wave attenuation with a mechanical configuration which can be quickly stowed or removed to provide passageway or space when the system is not in use;

(h) to provide a pressure wave attenuation structure to which other means of augmenting specific attenuating capabilities or to provide additional capabilities can be applied or installed within (such as adding insulation to protect the system from fire or radiation, providing intumescent coatings to provide additional thermal energy absorption from proximate explosions, or to include chemical fire-suppressing power or gaseous agents within); and (i) to provide explosion protection using the same agent as employed for fire fighting (aqueous foam fire suppressants).

More specifically, the present invention provides an acoustic/shock wave attenuating assembly formed by a flowable attenuating medium exhibiting aqueous foam characteristics and a confinement means for containing and supporting the flowable attenuating medium, the confinement means being porous with respect to the acoustic/shock wave for allowing the shock wave to penetrate the flowable attenuating medium. Porosity of the confinement means is more specifically characterized as macroscopic or microscopic openings allowing the shock wave to pass therethrough but, at the same time, absorbing considerable energy from the shock wave and creating turbulent zones or large numbers of miniature shock waves as energy from the shock wave passes into the flowable attenuating medium. With such porous material being preferably arranged on opposite sides of the attenuating medium, similar energy absorbing conditions occur as the shock wave penetrates and passes through both sides of the confinement means. In addition, substantial energy from the shock wave is absorbed by the flowable attenuating medium, particularly because of its containment and restriction by the confinement means.

Preferably, the flowable attenuating medium is an aqueous foam known to have substantial energy absorbing capabilities from the prior art as discussed above. However, the flowable attenuating medium may also be formed, for example, from solid particulate material preferably having bulk mechanical properties and flow properties of a fluid, the solid particulates also preferably comprising means for resisting relative displacement of the particulates in order to better simulate characteristics of an aqueous foam. In this regard, the term "flow properties of a fluid" and more specifically the term "mechanical properties and flow properties of a fluid" refer to the ability of the attenuating medium to act in the nature of a liquid mass to resist relative displacement by surface tension and viscous forces and the ability to substantially scatter and disperse pressure conditions transmitting therethrough by virtue of multitudinous curved surfaces dividing gaseous and solid or liquid or solid phases, and enabling the generation of turbulent flow fields by transmitting pressure conditions. More briefly, these terms may be taken as referring to the ability to resist applied shear forces in the nature of fluid viscosity. Finally, the above terms are also intended to refer to a tendency of the flowable attenuating medium to assume the shape of the confinement means while at the same time resisting applied shear forces in the nature of viscosity.

Numerous configurations are possible for the attenuating assembly of the invention. Preferably, the confinement means provides generally parallel side portions forming a panel in combination with the flowable attenuating medium supported therebetween for intercepting the acoustic/shock wave. More preferably, both side portions of the confinement means are porous in order to achieve maximum attenuation in the manner summarized above. It is even further contemplated that a plurality of such panel formations can be arranged with intervening gaps whereby the acoustic/shock wave may be effectively caused to successively penetrate the plurality of panel formations and intervening gaps in order to even more effectively attenuate the acoustic/shock wave.

A further possible configuration of the invention provides for placing the acoustic/shock wave attenuating panel combination between a structure and a surrounding liquid medium such as sea water for the purpose of protecting the structure from shock waves or other pressure wave phenomena arising from underwater explosions or seismic activity. In this application, an acoustic/shock wave attenuating assembly of one of the above mentioned configurations employs a non-porous membrane or rigid shell confinement means to isolate the surrounding liquid from a liquid transmitting medium emplaced between the confinement means and the acoustic/shock wave attenuating assembly. Preferably the flowable attenuating medium is an aqueous foam and the transmitting liquid medium being a homogeneous liquid without macroscopic gas bubbles or solid particulates in suspension.

It is also contemplated that the panel combination may be shaped to form a generally enclosed chamber. With both side portions of the confinement means being porous to the acoustic/shock wave, such a configuration is effective to attenuate the acoustic/shock wave passing in either direction through the panels.

It is yet another object of the invention to provide such a flowable attenuating medium in solid form, the attenuating medium being formed by solid particulates which may be hollow or otherwise include a gaseous phase, the particulates preferably being macroscopic and even more preferably have a dimension of at least about one millimeter.

It is a related object of the invention to provide such a solid attenuating medium wherein solid particulates are supported and more preferably also confined by a filamentary material forming a matrix. In such a configuration, the filamentary material preferably has mechanical integrity for providing confinement of the solid particulates in the matrix of filamentary material while allowing the solid particulates to be relatively displaced by interaction with pressure conditions so that the panel is capable of scattering and dispersing the pressure conditions passing therethrough. In such a configuration, the attenuating medium or panel further enables formation of turbulent flow fields from the pressure conditions.

Within such a configuration, the attenuating medium may be in the form of a flexible attenuating panel and may further comprise means interacting with the solid particulates and filamentary material in order to increase resistance of the solid particulates to relative displacement by the pressure conditions in addition to resistance attributable to inertia forces.

It is a still further object of the invention to provide a flowable attenuating medium for the present invention in the form of an aerogel, a very light weight material described in greater detail below.

It is also a further object of the invention to provide the attenuating medium and related components for protective applications, particularly in connection with ammunitions or devices of a type generally referred to as shaped-charge or hollow-charge devices, as described in greater detail below.

It is a related object of the invention to also employ the attenuating medium and related components of the invention for protecting explosive charges or devices themselves from interaction or detonation, this phenomenon being commonly referred to as "sympathetic detonation", "fratricide", "propagation" or "chain reaction", as also described in greater detail below.

It is yet a further object of the invention to employ the attenuating medium and associated components of the invention to provide a liner for containers, either to protect the contents of the container from external blasts or to protect the exterior of the container from blasts within the container. Accordingly, the invention particularly contemplates use in connection with air cargo containers and the like.

It is also a further object of the invention to employ a shield of a frangible material in combination with the attenuating medium for protecting against weather and the like while still permitting the desired function of the attenuating medium as also described in greater detail below.

It is another object of the invention to employ the attenuating medium in combination with honeycomb, the honeycomb preferably providing at least part of the support for the attenuating medium.

Additional objects and advantages of the invention are to provide total reliability and effectiveness by using no moving or electrical components, and by not depending upon materials which must be without flaws, imperfections, or other defects. Operation of the invention is possible using materials in common use for years, and is not dependent upon development of materials, means of manufacture, or analytical methods not currently available. Most significantly, the invention provides substantial attenuation of all types of pressure waves on the source side as well as the remote side of the pressure wave attenuating structure. In the case of proximate explosions, substantial reduction of both overpressure and thermal effects have been experimentally verified on the blast side as well as the opposite side of the pressure wave attenuating structure.

Further objects and advantages of the invention will become apparent form a consideration of the drawings and ensuing description.

DESCRIPTION OF THE PREFERRED EMBODIMENTS

The various drawing figures accordingly illustrate a number of embodiments according to the present invention. Those embodiments are summarized below followed by a more detailed description of the respective figures.

Figure 1:
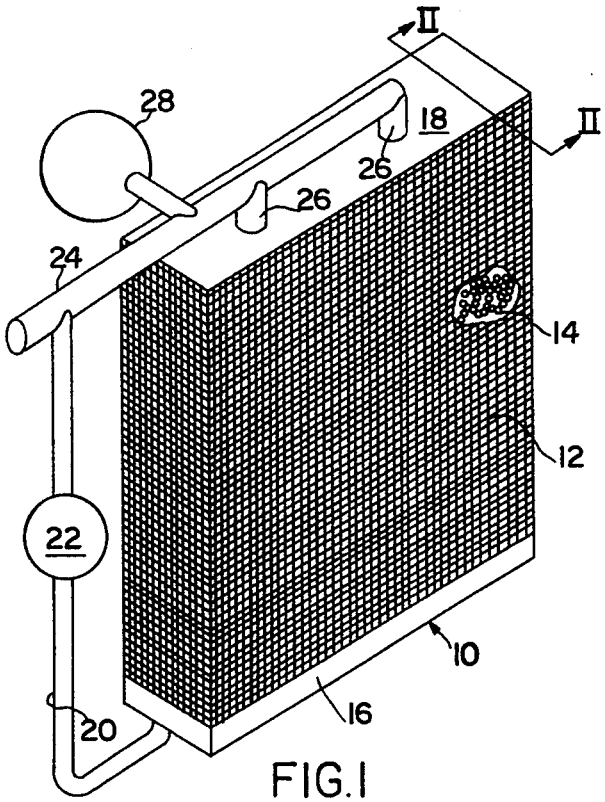
FIG. 1 is a perspective view of a panel configuration for the attenuating assembly of the invention. The panel assembly is preferably contemplated for containing an aqueous foam as the flowable attenuating medium. Accordingly, the assembly of FIG. 1 illustrates means for recycling and regenerating the aqueous foam within the confinement means.

FIG. 1 is a perspective view of a basic version of the pressure wave attenuation device. The device comprises two mesh or perforated solid screens which are parallel or substantially parallel for planar configurations and concentric or substantially concentric for cylindrical, spherical or other three dimensional forms which can be generated by revolving a planar curve about an axis, with a pressure wave- attenuating fluid, such as aqueous foam or vermiculite beads, emplaced and filling the space between the mesh or perforated sheet screens. The screen elements may be flat or corrugated, or a combination thereof. The screen elements are either held in place by a rigid structural frame or by otherwise suspending and securing the lower edges of the screens to prevent their displacement. The minimum spacing between screens is preferably the least distance between perforations in perforated sheet screens or least dimension of mesh openings in mesh screens.

Additional embodiments of the invention are shown in FIGS. 2–15. As illustrated, the basic configuration can be modified with the addition of any combination of mesh screen, perforated solid, or solid materials connecting to the mesh or perforated sheet screens of the basic version of our invention, or to the frame members which comprise the edge supporting members of the screen elements of the FIG. 1 basic version, which would then form top, bottom, and side surfaces as shown in FIG. 2.

Figure 2:
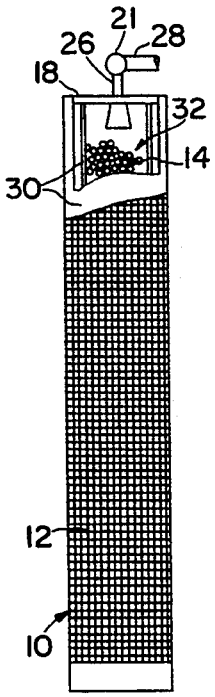
FIG. 2 is a view taken along section lines II—II of FIG. 1 and better illustrates the interaction of the confinement means with the flowable attenuating medium.

The invention may include one or more linings, as shown in FIG. 2. These linings may be connected or affixed to any of the mesh or perforated sheet screen elements, or to the structural members holding the screens in place, or may be suspended. Said linings may be in the form of a sealed enclosure or bag emplaced between the screen elements of the basic version of the invention, into which the pressure wave attenuating medium may be introduced.

Figure 5:
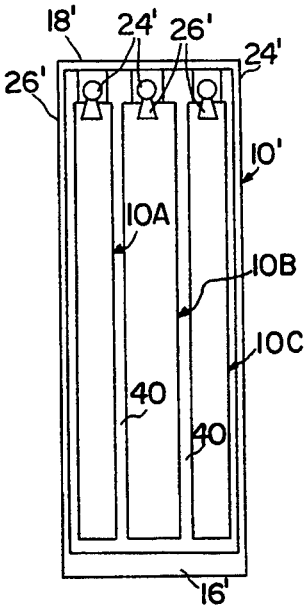
FIG. 5 is a view similar to FIG. 2 while illustrating multiple panel assemblies of similar construction with intervening gaps in order to even more effectively attenuate the acoustic/shock wave.

Additional mesh or perforated sheet materials in any number or combination thereof between the screens comprise outer surfaces of the basic version of the invention to form interior screen elements in a sandwich configuration, thus forming a sandwich arrangement of a plurality of acoustic/shock wave attenuating assemblies as shown in FIG. 5. Linings may be emplaced between one or more of these interior screens and elements forming the outer surfaces of the invention. The preferred embodiment of the invention uses corrugated mesh screens to form the outer surfaces, flat mesh comprising the interior screen elements, waterproofed paper lining inside the screen elements and with aqueous foam filling the sandwich formed by the above elements.

The pressure wave attenuating fluid may be emplaced in the volume formed between an interior screen element and an outer screen, or between any two interior screen elements where a plurality of interior screen elements is employed, or in any combination of such spaces. This fluid may be aqueous foam, a gas emulsion, (wherein a gas is entrained and dispersed through a liquid matrix in the form of bubbles, with the gas bubble diameters generally commensurate with the thickness of the liquid bubble walls), a gel (preferably with entrained gas), or granular or other solid particulates having necessary flow characteristics. Gas may be emplaced and confined by an enclosing element in one or more of the gaps between each sandwich assembly, with the gas pressure being equal to, greater than, or less than atmospheric or ambient pressure. Vacuum conditions may be generated in one or more of the gaps between each sandwich assembly.

The embodiments of the various figures are described in greater detail below.

Referring initially to FIG. 1, an acoustic/shock wave attenuating assembly is generally indicated at 10. Confinement means for the assembly comprises a screen or grid 12 arranged on four sides of the assembly to provide an enclosure for the flowable attenuating medium 14.

As illustrated in FIG. 1, the bottom of the assembly 10 is formed by a tray 16 while the top of the assembly is formed or enclosed by a plate 18. The tray 16 and plate 18 function in combination with the screen 12 to completely enclose the flowable attenuating medium 14 within the assembly 10.

The flowable attenuating medium 14 in the assembly of FIG. 1 is preferably contemplated as an aqueous foam of the type noted above. Since such aqueous foams are subject to deterioration wherein the foam degenerates into a gaseous phase and a liquid phase, the assembly 10 is adapted for recycling and regenerating the aqueous foam in order to assure that it falls the space within the assembly 10. The tray 16 serves to receive and collect the liquid phase from such deteriorated foam. The liquid is recycled through a line 20 by a pump 22 to a manifold 24 having multiple connections 26 through the upper plate 18 for returning regenerated foam to the assembly 10. Preferably, a source of gas 28 is provided for regenerating the foam within the manifold 24 so that it can flow downwardly into the assembly 10.

When aqueous foams are used as the flowable attenuating medium 14, they may be generated from any foamable agents, preferably those which are normally used in fire suppression. Such agents include hydrolyzed protein liquids, proteinaceous liquids with fluoropolymeric additives, along with a large number of synthetic surfactant and stabilizing chemical combinations. The foaming gas for use in the gas source 28 may be of a similarly wide range so long as the gas is not chemically reactive in a destructive manner to the stabilizing components in the bubble wall liquids. Foaming gases would preferably include inert elements such as argon or fire extinguishing compounds such as carbon dioxide, sulfur hexafluoride, or halogenated carbon agents (halons). Compressed air is also an acceptable foaming gas.

Referring now to FIG. 2, the screen 12 forming the confinement means for the flowable attenuating medium may not be sufficient for maintaining an aqueous foam within the assembly 10. Accordingly, FIG. 2 illustrates a preferred embodiment wherein a liner 30 is arranged inside the screen 12. The screen 12 formed from metal, plastic or the like thus remain very porous to the acoustic/shock wave. At the same time, the liner 30 serves to maintain the aqueous foam within the interior 32 of the assembly 10. At the same time, the liner 30 is also porous to the acoustic/shock wave as defined above. Preferably, the liner 30 is formed from paper or film which is resistant to wetting by the aqueous foam. At the same time, the liner 30 tends to be readily ruptured by the shock wave so that it does not interfere with penetration of the shock wave into the attenuating medium 14 and thereby reduces the reflected overpressure that inevitably develops when shock waves impinge upon a solid surface. The liner 30 thus serves to even further attenuate the acoustic/shock wave in combination with the screen 12 and the flowable attenuating medium 14.

Figure 3:
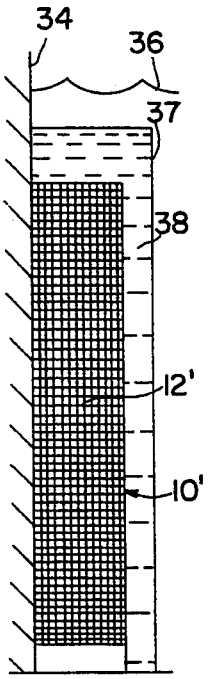
FIG. 3 is a view similar to FIG. 2 and illustrates yet another embodiment of an acoustic/shock wave attenuating assembly according to the present invention which is placed between a structure to be protected from shock waves and other pressure wave phenomena transmitting in a surrounding liquid medium.

Referring now to FIG. 3, another embodiment of an acoustic/shock wave attenuating assembly is generally indicated at 10', and is placed in such an arrangement whereby the structure 34 is situated on the side of the assembly 10' opposite the liquid surrounding medium 36. A solid, non-porous membrane or rigid shell 37 provides confinement and isolation from the surrounding liquid medium 36 for an acoustic/shock wave transmitting liquid 38.

Figure 4:
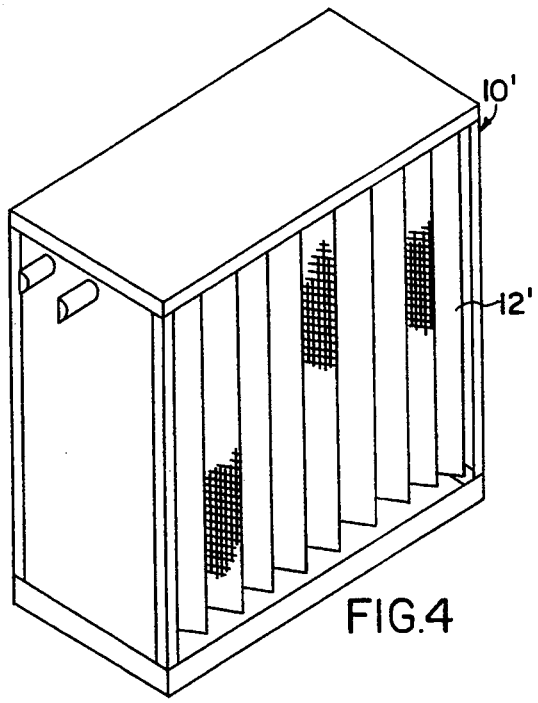
FIG. 4 illustrates a variation of the panel configuration wherein the side portions of the confinement means are articulated or corrugated in order to provide increased surface area and generate greater turbulence in the flowable attenuating medium, thereby producing even more effective attenuation for the acoustic/shock wave.

FIG. 4 illustrates yet another embodiment of the invention 10' which is substantially similar to that illustrated in FIGS. 1 and 2. However, the screen 12' in FIG. 4 is corrugated or articulated or otherwise configured to have a substantially increased surface area in order to more effectively attenuate the acoustic/shock wave. Additionally, the corrugations or articulations serve to greatly increase turbulence and formation of miniature shock waves, and thereby specifically and even more effectively attenuating shock waves.

Referring now to FIG. 5, another embodiment of an acoustic/shock wave attenuating assembly is generally indicated at 10' and comprises panels 10A, 10B and 10C similar to the overall panel assembly of FIGS. 1 and 2. The panels 10A, 10B, and 10C as illustrated in FIG. 3 are spaced apart to form intervening gaps indicated at 40. Thus, an acoustic/shock wave approaching the assembly of 10' of FIG. 5 laterally would be caused to sequentially penetrate the panels 10A, 10B and 10C as well as the intervening gaps in order to even more effectively attenuate the acoustic/shock wave. Otherwise, the various components for the multiple panels in the embodiment of FIG. 5 are indicated by similar primed numerals in FIGS. 1 and 2.

Figure 6:
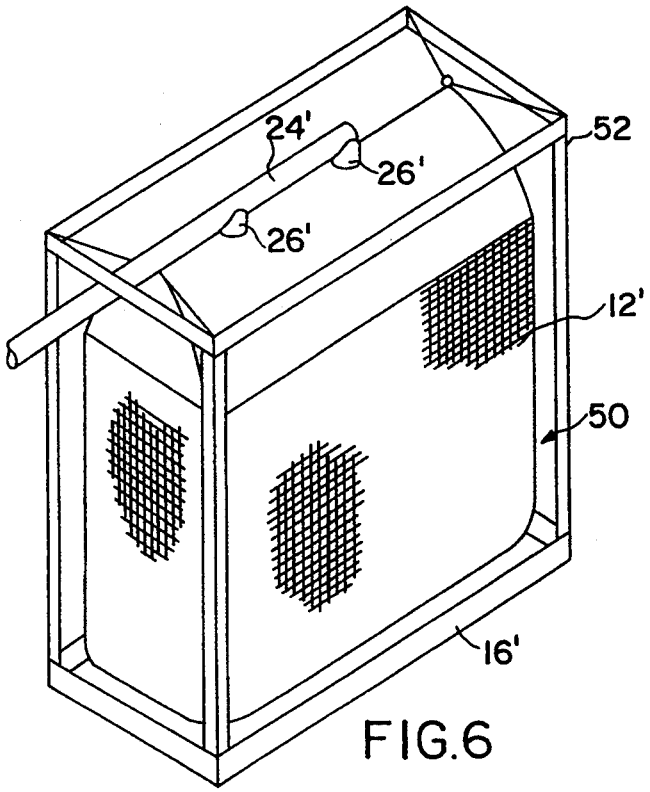
FIG. 6 illustrates yet another embodiment of an acoustic/shock wave attenuating assembly according to the present invention wherein the confinement means and the flowable attenuating medium contained therein are supported in common from a suitable structure.

Referring now to FIG. 6, yet another embodiment of an acoustic/shock wave attenuating assembly is generally indicated at 50 and also includes components generally similar to those described in FIGS. 1 and 2. Accordingly, corresponding components in FIG. 6 are indicated by similar primed numerals. Generally, the screen or confinement means 12' in FIG. 6 is in the configuration of one or more bags for containing the flowable attenuating medium 14'. At the same time, the bags or confinement means 12' is suspended from a fabricated structure 52. The fabricated structure 52 thus tends to provide a panel configuration for the assembly even with the confinement means or bags 12' being very flexible by themselves.

Figure 7:
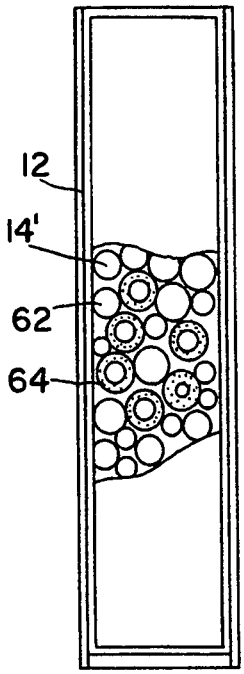
FIG. 7 is a fragmentary view in section of a flowable attenuating medium for the assembly of the present invention formed from solid particulates.

Referring now to FIG. 7, another embodiment or variation of the flowable attenuating medium 14' is illustrated. The flowable attenuating medium 14' of FIG. 7 is formed from solid particulates 62 preferably having both mechanical properties and flow properties of a fluid. Also preferably, the solid particulates include means for resisting relative displacement of the particulates in order to better simulate characteristics of an aqueous foam. For such a purpose, the particulates 62 may be provided with a coating 64 to resist relative motion between the particulates while permitting flow in accordance with the present invention. For example, the coating 64 may be a light adhesive or may even comprise Velcro type hook and loop fasteners for resisting relative movement between the particulates. It is noted that VELCRO is a trademark for such a hook and loop type fastener.

Solid particulates 62 may be of any shape, including spherical and irregular forms. The largest diameters or largest cross sectional dimensions of particulates used in this invention should be generally less than half the distance between the generally parallel screens 12. The solid particulates 62 should generally be macroscopic. These particulates may be hollow with solid surfaces, solid shells with internal cavities containing liquid phases, or may be comprised entirely of solid materials. The solid material may be a solid foam, such as a polyurethane or elastomeric compound, or otherwise be a sponge, whereby the gas and solid phases are both continuous, which thus distinguishes sponges from foams, wherein the gas phase is entirely enclosed within a liquid or solid continuous phase. Alternatively, the solid particulates may be comprised of entrapped gas phases, for example, in the nature of volcanic foam glasses, perlite, pumice or the like.

Any of the solid particulates of the invention may be flexible or elastic, or conversely may be rigid in their mechanical properties.

Figure 8:
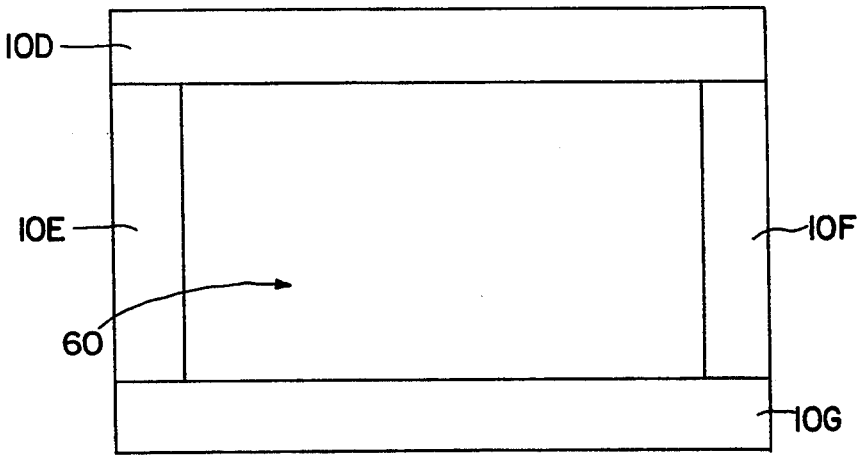
FIG. 8 illustrates the arrangement of a plurality of panel assemblies each generally similar to that of FIG. 1 to form a generally enclosed prismatic chamber.

Referring now to FIG. 8, multiple panels 10D, 10E, 10F and 10G are formed in generally the same manner as the assembly 10 of FIG. 1. However, the panel assemblies 10D–10G are suspended or otherwise supported to enclose and define a chamber 90 which may also be used for a number of applications as described below.

With any of the embodiments of FIGS. 1–8, either the confinement means comprising the screen 12 and liner 30 and/or the flowable attenuating medium 14 itself may be formed from materials absorbing substantial additional energy from the acoustic/shock wave. For example, intumescent and ablative materials may be employed either as coatings, treatments for the lining 30, or as comprising materials of solid particulates 62 or coatings for these particulates 64. Alternatively, other materials which absorb thermal energy through an endothermic chemical reaction may be used as linings 30 or as treatments for these linings, or otherwise or in addition to coatings of the screen 12 and solid particulates 62 where these are employed.

Figure 9:
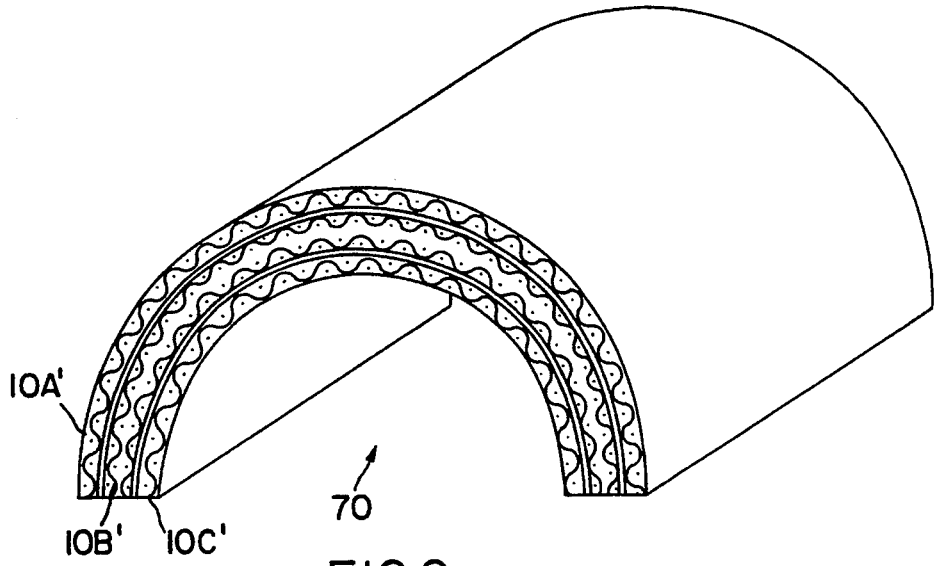
FIG. 9 illustrates yet another embodiment of an acoustic/shock wave attenuating assembly constructed according to the present invention wherein the panel combination of the confinement means and flowable attenuating medium forms a generally enclosed chamber. More specifically, the panel combination illustrated in FIG. 9 forms a cylindrical portion open at both ends.
Figure 10:
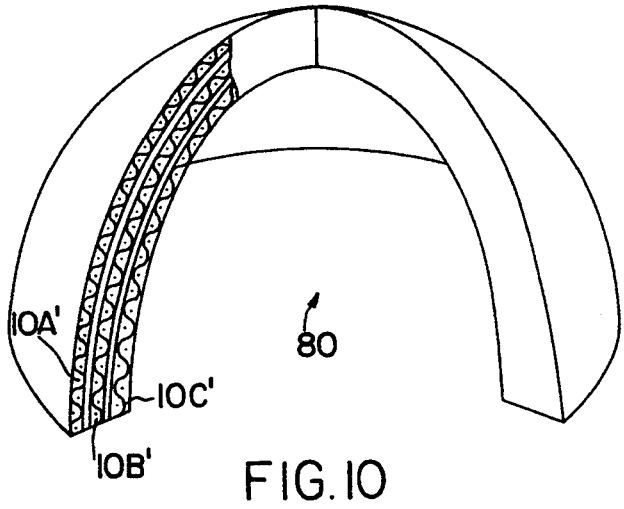
FIG. 10 similarly illustrates such a panel combination formed generally as a dome to completely enclose a chamber therebeneath, with a section removed to show its construction.
Figure 11:
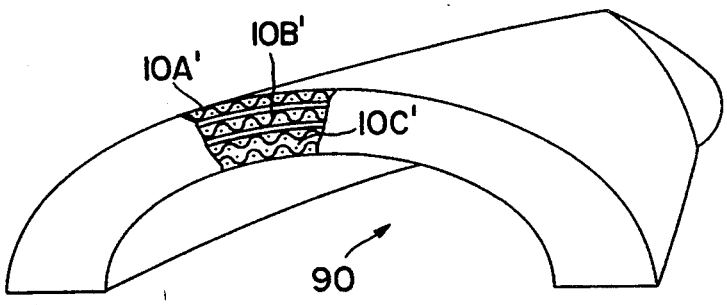
FIG. 11 also similarly illustrates yet another configuration wherein the panel combination is arranged with an irregular shape to also form a chamber therebeneath open at one end.

FIGS. 9, 10 and 11 illustrate similar panel configurations, preferably multiple panels with intervening gaps, formed as generally rigid structures with enclosed shapes to substantially form a chamber therebeneath. These structures of FIGS. 9–11 may be employed in a number of applications as described in greater detail below.

Referring initially to FIG. 9, multiple panels 10A', 10B', and 10C' are commonly formed as a portion of a cylinder to define the chamber 70 therebeneath. The chamber is at the ends as illustrated.

FIG. 10 illustrates yet another arrangement of multiple panels, 10A', 10B' and 10C' configured as a dome configured as a dome forming a chamber 80 which is completely enclosed therebeneath. FIG. 10 provides a fragmentary section of the multiple panel assemblies 10A', 10B' and 10C' comprising the dome chamber 80.

FIG. 11 illustrates a relatively irregular configuration for similar panels 10A', 10B' and 10C' to form a chamber 90 which is substantially enclosed therebeneath while being open at one end. Here again, such a configuration may be used to advantage in particular applications.

Figure 12:
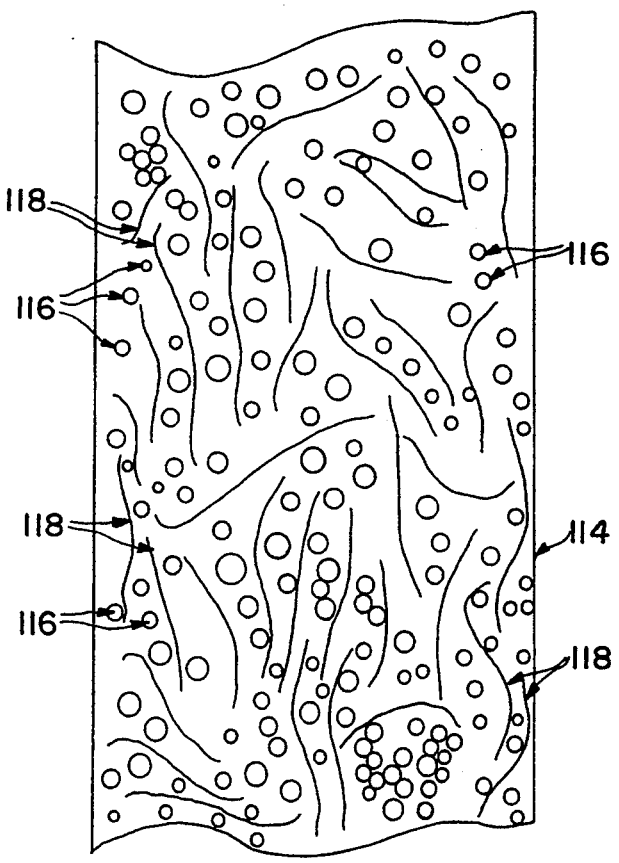
FIG. 12 is a view of another embodiment of the acoustic/shock wave attenuating assembly of the present invention wherein the attenuating medium is formed as a flexible panel including solid particulates confined and also preferably supported by filamentary material.
Figure 13:
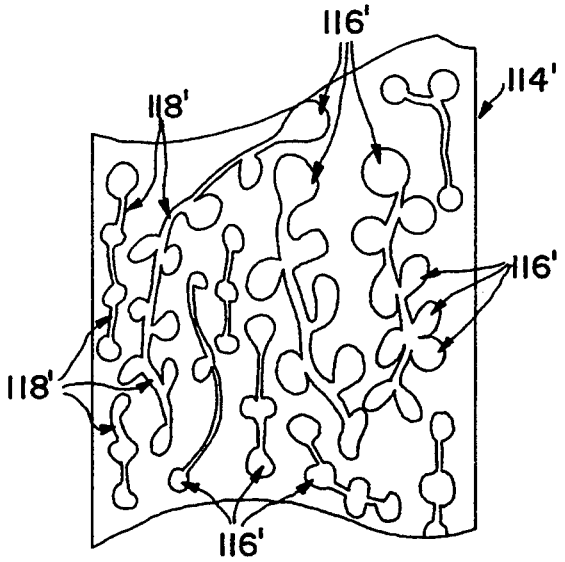
FIG. 13 is an enlarged fragmentary view of a portion of a flexible panel similar to that of FIG. 8 but wherein the solid particulates are integrally formed with the filamentary material.
Figure 14:
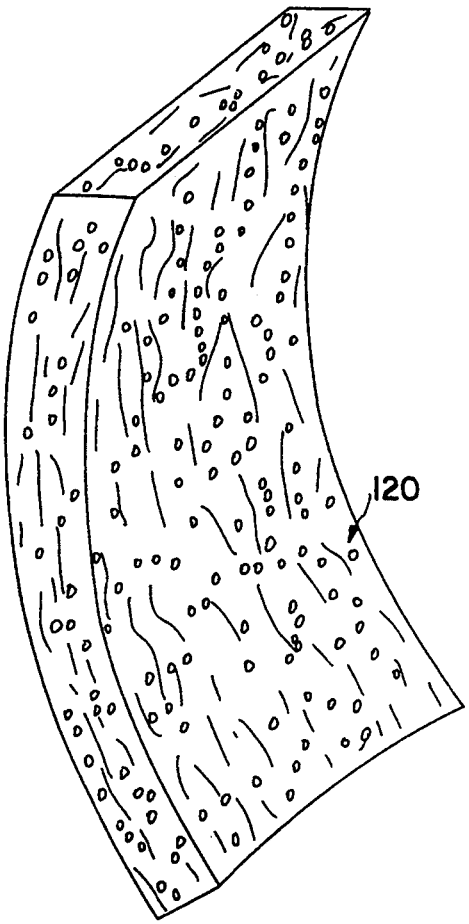
FIG. 14 illustrates a flexible panel formed from an attenuating medium comprised of solid particulates and filamentary material in generally a similar manner as in FIGS. 12 and 13, the flexible panel being usable as insulation, a cushioning component, curtain barrier or lining material for example.

FIGS. 12–14 illustrate another embodiment of the invention wherein the attenuating medium 114 is formed by solid particulates 116 dispersed in a matrix of filamentary fibers 118. The solid particulates 116 and the filamentary fibers 118 together comprise a substantial portion of the solid phase for the attenuating medium 114. In this embodiment, the filaments serve to entrap the particulates while allowing them to experience limited displacement and oscillations induced by pressure waves passing through the medium. The allowed displacement of the solid particulates thus provides the ability for transmitting shock waves to generate turbulent flow fields among the solid particulates as well as for the filaments themselves to oscillate and further enhance turbulent flow field magnitude. Aerogel materials may be used to partially or entirely replace the attenuating medium 114, as described in greater detail below.

Within the embodiment of FIG. 12 and also in FIGS. 13 and 14, the filamentary material or fiber 118 also serves as a means for confining and preferably for supporting the solid particulates.

In this regard, FIG. 13 illustrates a flexible panel 120 formed from an attenuating medium 114 substantially similar to that of FIG. 12.

FIG. 13 illustrates a fragmentary section of attenuating medium 114' including solid particulates 116' and filamentary material or fibers 118'. In the embodiment of FIG. 13, the solid particulates 116' are formed as an integral portion of the filaments or fibers 118' in a manufacturing process described in greater detail below.

In the embodiment of FIG. 13 or in the embodiments of FIGS. 12 and 14, for example, the solid particulates and the filaments themselves may be solid or hollow. For example, cavities may be created in the solid particulates and/or in the filaments by the manufacturing process. The cavities (not shown) may be filled by a liquid, gas or powdered solid. In the case of powdered solids, they would preferably have a mean diameter of less than about 0.1 millimeters.

Figure 15:
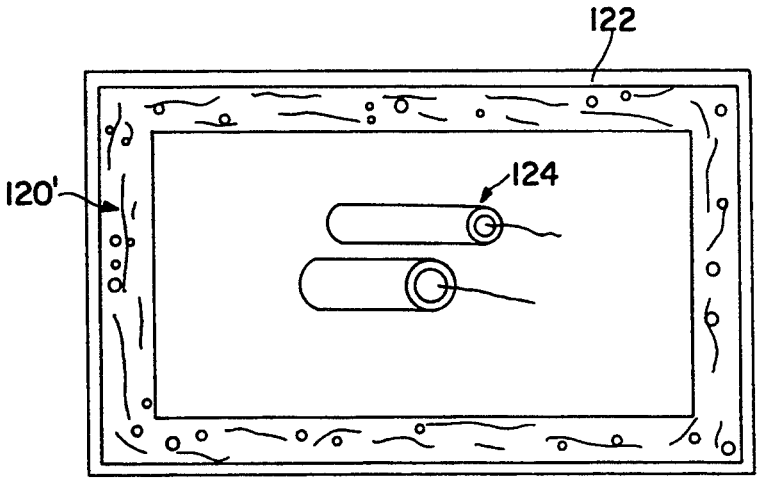
FIG. 15 is a cross-sectional view of flexible panel as illustrated in FIG. 14 employed as a lining in a container.

Referring also to FIG. 15, the flexible panel 120 may be employed as a liner 120' in a container 122. In this manner, the liner 120' may be employed for containing pressure conditions including acoustic and/or shock waves as disclosed above, generated for example by means of an explosive device 124.

Referring in combination to FIGS. 14 and 15, the flexible panel 120, optionally employed as a liner 120' in FIG. 15, consists of solid particulates and filamentary fibers as disclosed above. The flexible panel may be used in order to mitigate deleterious effects produced by an explosion resulting from the device 124 in the container 122. Such a configuration might be employed for example where the container 122 is a cargo carrying hold with the explosive device 124 being a part of the cargo.

In such a configuration, the attenuating medium 120 can be made by introducing substantial quantities of the solid particulates into a batch process as is typically used in the manufacture of glass fiber insulating batts (not otherwise shown). Uncured binder (also not shown) may be used to weakly attach solid particulates to the glass filaments to the desired extent in this embodiment of the attenuating medium.

The attenuating medium of FIGS. 12 and 13 may be used as a filler in assemblies such as illustrated in FIG. 1, for example, or may act as an attenuating assembly in and of itself wherein the attenuating assembly is used as a lining or otherwise suspended.

The attenuating medium of FIGS. 12 and 13, for example, may be formed for example from conventional insulating materials, preferably a variety of minerals well known to those skilled in the art. For example, thermal insulation of a type suitable for forming the attenuating medium 114 may be a material available for example from Schueller International Corporation under the trademark MIN-K and in a variety of configurations. Such a material includes both the solid particulates 116 and filamentary fibers or material 118 as illustrated in FIG. 12. Furthermore, such materials may be provided with a variety of other characteristics adding superior performance in the attenuating medium of the invention. Such characteristics include low conductivity, reduced conductivity at high altitudes, low thermal diffusivity, flexibility, the capability of being molded, etc. These materials are also available in forms lending themselves to bonded together or to other materials and may be obtained with special coatings such as silicones and the like.

As noted above, the attenuating medium 114 of FIG. 12 may include a variety of materials forming both the solid particulates and the filamentary material. For example, the filamentary material may be fiberglass or a variety of other minerals or plastics for example. The solid particulates may be formed from the same material as the filamentary material or from other materials such as vermiculite, perlite, pumice, hollow glass beads, etc.

The solid particulates and/or the filamentary material may be more densely distributed in selected regions of the attenuating panel in order to achieve focusing and/or diffraction of pressure conditions passing therethrough. The solid particulates and filamentary material may also preferably be formed from materials of high reflectivity in the infrared portion of the electromagnetic spectrum or such materials may be formed on surfaces of the solid particulates and/or filamentary material. Such a high reflectivity material may include titanium, for example in titanium dioxide. As noted elsewhere, materials in the solid particulates and/or filamentary material may also be selected with characteristics for extinguishing combustion reactions.

The invention may operate as a partition, lining, container, barrier or barricade, wall element, or structure standing independent of any exterior need of support or attachment. The invention may operate as an acoustic or shock wave barrier, simultaneously be employed for attenuation of all types of pressure waves, or for protection exterior to the invention or on either side of the invention when employed as a partition or wall structure. The invention may also operate as an acoustic wave absorber for protection of spaces either formed by the invention or in which partitions or lining elements of which variants of the invention comprise a part are situated. The invention may serve a secondary purpose as reservoir of fire fighting aqueous foam agents.

The basic version of the invention becomes operable when the pressure wave attenuating fluid is emplaced between two adjacent screen elements. Pressure waves impinging on the invention from any angle are reflected when they encounter screen and solid elements of the invention, and are admitted into the flowable attenuating medium when the incident waves encounter the porous openings. Pressure waves transmitting through the outer screen element are substantially slowed and scattered as they travel through the flowable attenuating medium, particularly where this medium is an aqueous foam.

Portions of the transmitting waves are reflected upon encountering the second, or rear, screen of the acoustic/shock wave attenuating assembly and the gas (or vacuum, as may be employed)/fluid interface, and remaining portions of transmitting pressure waves are dispersed as they encounter the interface between the pressure wave attenuating fluid and contiguous gas or solid. A substantial fraction of the initially incident pressure wave will thus undergo multiple reflections within the fluid confined between screen elements, in essence, substantial portions of the incident pressure wave are trapped within the screen/fluid sandwich. With a plurality of screen/fluid sandwich layers, this effect will be magnified.

When aqueous foams are used, substantial energy is removed from the incident pressure wave by scattering at the multitudinous interfaces presented by bubble wall liquids and the gas entrapped which comprise: the basic units of aqueous foam structures, and through the displacement of the liquid in the aqueous foam. A similar effect is obtained when solid bead materials are employed—particularly solids with entrained gas, such as vermiculite and organic solid foams. For the particular case of aqueous foams, substantial energy is also removed from pressure waves reflected back into the attenuating fluid from screen components due to turbulent flow fields established by passage of the initial pressure wave. This is impossible for solid foam materials.

Additional energy and thus attenuation of transmitting pressure waves is accomplished by cancellation as scattered, slowed and reflected waves become coincident. A further contributor toward energy removal by the invention is that propagation paths of pressure waves through the foam are substantially lengthened by their scattering and dispersion.

Incident shock waves are attenuated by additional phenomena generated by the invention. Shock and blast waves consist of an initial overpressure, or positive pressure phase (in excess of the ambient initial pressure) followed by a negative, or rarefaction, phase. The rarefaction phase is typically longer in duration unless the shock wave undergoes reflections. Because shock waves transmitting through aqueous foams are substantially slowed and thereby further expanding the rarefaction wave duration relative to the overpressure portion, and at different values due to random dispersion within the foam, destructive interference by coincidence of positive and negative pressure waves is substantially increased with respect to unconfined aqueous foams or foams in simple containers.

Another substantial factor related to destructive interference between pressure wave components is that weaker (slower) shock waves have been shown to separate into two components when transmitting through aqueous foams. The precursor wave is lower in amplitude but propagates at a higher velocity. The main wave follows, it is larger in magnitude but tends to lose velocity with respect to the precursor wave during passage through aqueous foam. The present invention uniquely utilizes this phenomenon in two ways, by slowing strong shock wave propagation until the wave separates into precursor and main wave components, then causing reflecting of the two components in such a manner as to promote destructive interference or cancellation.

Additionally, shock waves displace bubbles and accelerate liquids in bubble walls of the aqueous .foam, causing the bubbles to shrink and many to collapse. This displacement of the liquid, the breaking of bubble walls against the cohesive force of their surface tension, and the acceleration of liquid droplets formed from shattered bubble walls all serve to absorb substantial energy from the transmitting shock wave. Substantial parts of the transmitting shock wave are reflected back into the aqueous foam at the interface between the foam and contiguous gas or solid, a process which is repeated numerous times by part of the original incident pressure wave, in essence trapping part of the original incident pressure wave.

Yet another substantial contributor to energy removal from the incident shock wave, thus attenuating such waves, is that the incident wave creates choked flow conditions within the mesh or perforated sheet openings, which serves to reflect a portion of the incident shock wave. In this manner, only a fraction of the energy carried by the incident shock wave is allowed to pass through the first screen encountered. Where the transmitted shock encounters another screen, another fraction of this shock wave is reflected back. When the reflected wave must travel through aqueous foam dispersion and attenuation of the wave is greatly increased through the phenomena described in the preceding paragraph. Turbulent flow fields are also established in the vicinity of screen elements by shock wave passage through screen openings, which significantly contribute to scattering of pressure waves within the foam and by transmitting pressure waves beyond.

Employment of an intervening evacuated space, a space filled by gas, or a space filled with solid particulates in which a vacuum or gas is present between spaces filled with aqueous foam or other flowable attenuating media will greatly increase pressure wave attenuation. Evacuated or vacuum spaces will not transmit pressure waves. Incident pressure waves will reflect at the solid surface which confines the vacuum or gas unless sufficiently intense as to rupture the confining surface. Upon rupture of the confining surface, the pressure wave would be transmitted by the flowable attenuating medium accelerated through the rupture, and the ambient gas able to leak into the formerly evacuated space. However, only a small portion of the incident pressure wave could be conveyed in this manner due to the small mass and irregular structure of accelerated, unconfined flowable attenuating medium. Further reflection and scattering of the transmitted pressure wave occurs upon encountering successive screens, linings, and foam interfaces.

Employment of corrugated screens in any location of the invention provides additional scattering and turbulence, which therefore further increases attenuation. Pressure waves impinging on the flowable attenuating medium from a gaseous medium arrive at the corrugated interface at differing times and at different angles. Scattering and dispersion of the transmitting pressure waves is thus enhanced. Furthermore, the path through the flowable attenuating medium is thus greater for a fraction of the transmitting pressure wave from the instant of first encounter with the foam. Since aqueous foam is known to substantially reduce the propagation velocity of pressure waves, further dispersion and destructive interference of transmitting wave components is accomplished when they are.

Linings serve to provide confinement for aqueous foams, and for solid particulate materials when these are employed. Some reflection of incident pressure waves will occur upon impingement, and such linings may provide additional acoustic barrier capabilities. Where the invention is employed primarily for blast and shock wave attenuation, linings and any other materials used to confine gases or maintain vacuum conditions must rupture or otherwise provide openings upon the impingement of shock waves at a pressure substantially below that of the impinging shock wave in order to avoid substantial pressure rise as is inevitably created by solid obstructions in these situations.

Coatings or chemical additions which serve to absorb thermal and radiant energy may be used on any element or combination of elements comprising the invention. Such chemicals reduce the energy of incident blast waves due to the mathematical linkage between blast wave temperature, overpressure, and propagation velocity, which serves to enhance attenuation of the incident blast wave. The invention operates with or without the presence of an increase in temperature, however, so that thermal energy absorbing materials only serve to enhance capabilities in certain applications.

Accordingly, the pressure wave attenuating device can be used for any type of pressure wave transmitted in a gaseous medium. The invention requires no electric power source or sensor to operate since aqueous foam generation and filling can be accomplished using only a compressed gas source with which to create and mechanically place the foam within the desired space or spaces. There are no electronic or mechanically sensing components which can prevent the invention from functioning. An additional advantage of the pressure wave attenuating device is that other energy absorbing or protective features may be added to enhance its attenuating capabilities or to provide additional capabilities, such as stopping fragments from explosions. Typical applications would enable the same aqueous foam agents and generating equipment as are commonly used in fighting fires to be employed in the invention.

Attenuation of acoustic waves is accomplished without regard to intensity, directionality, or frequency. This device operates regardless of orientation with respect to impinging pressure waves or, where present, confining walls defining an enclosure in which the invention is placed. Because of the light weight of aqueous foams and the structural elements required by the attenuating assembly described above, this invention is easily made portable in sizes useful for noise suppression around aircraft with jet or gas turbine engines. When protected from heat and sunlight, aqueous foams are stable for prolonged periods enabling the pressure wave attenuating device to be employed as acoustic walls in anechoic chambers or other applications requiring acoustic wave damping in enclosures.

Simultaneous attenuation of all types of pressure waves affords the invention the capability to serve as means to dispose of explosives and ordnance near structures or inhabited areas. By mitigating blast energy, noise and shock waves are attenuated. Bomb fragments are stopped by a combination of reducing propelling energy and by multiple layers of high strength screen materials. These same capabilities enable this device to be employed to provide protection of artillery crews exposed to enemy artillery and air dropped munitions from both blast effect and from the noise produced by their own guns.

The ability of the pressure wave attenuating device to operate in a variety of configurations enables it to be employed to provide blast protection on board aircraft which may carry explosive devices meant to destroy the aircraft, and for protecting personnel sent to remove or disarm such devices when discovered. The invention can be configured to operate in curved spaces such as missile launchers used aboard warships, around machinery in hazardous environments such as in petrochemical refining and production facilities, or as protective barriers around rescue equipment. Our pressure wave attenuating device is unique in its ability to operate effectively in unconfined environments. Furthermore, our invention operates effectively without a requirement to be located close to the source of the pressure wave, or without a specific orientation thereto.

Furthermore, the variety of configurations allowed by this invention enable the acoustic/shock attenuating assembly to be employed for protecting ships and offshore structures from shock effects arising from underwater explosions when aqueous foams are employed as the flowable attenuating medium. The invention can similarly be used for protecting offshore and coastal structures from seismic shock effects as well as aquatic life from any type of shock waves in water. This can be accomplished by using a lining which confines a fluid which serves to transmit the pressure wave between the outer screen and a lining which confines aqueous foam in the manner of sonar type acoustical detection devices wherein a membrane is filled with water or other fluid to conduct acoustic waves.

The invention preferably employs aqueous foam agents which have neither toxic qualities nor produce toxic compounds as a result of operation. It is light in weight and may easily be stowed in most of its configurations when not needed or when being transported. When used in confined spaces, the invention occupies a small fraction of the enclosed volume and does not involve flooding. The acoustic/shock wave attenuating assembly enables personnel to occupy and work in that space, which only explosion vents allow among all possible blast pressure mitigating means in current use. Unlike explosion vents however, the invention uniquely is usable in situations which proscribe opening confined spaces to adjoining spaces. This is critical aboard ships, which cannot be opened to the sea, and within any structure where smoke and combustion products must be confined to avoid harm to trapped individuals and to facilitate emergency crew operation.

In addition to the use of solid and liquid attenuating mediums as described elsewhere, the invention further contemplates that substantially all embodiments of the invention are adapted for use with a class of very light weight materials generally referred to as "aerogels". These materials are similar in structure, at least in certain aspects, to the filamentary materials described in one of the preceding embodiments of the invention. However, the aerogels differ in their formation by the inclusion of multitudinous small cavities filled with a gaseous phase. Such aerogels can be manufactured with extremely low densities, almost down to that of atmospheric air at sea level, and have long been know to those skilled in the art of low density structures, etc.

Rather than describing such aerogels in greater detail herein, it is noted that the structure and typical compositions of such aerogels are described in a number of references, particularly an article by Jochen Fricke, entitled "Aerogels", *Scientific American,* Vol. 258, No. 5, May 1988, pp. 92–97. This reference is incorporated herein as though set forth in its entirety.

It is to be understood that such aerogels, because of their extremely low density, are desirable for forming variations of substantially any of the embodiments of the invention where minimum weight is important. It is further noted that a flowable attenuating medium formed from aerogels may use generally the same support structures disclosed for the attenuating medium in different embodiments of the invention. Accordingly, the attenuating medium described in substantially all of the embodiments of the present invention may be replaced partially or entirely by such aerogel materials.

A further embodiment of the invention is described immediately below with reference to FIG. 16 which illustrates the use of an attenuating medium in combination with a frangible element or covering.

Figure 16:
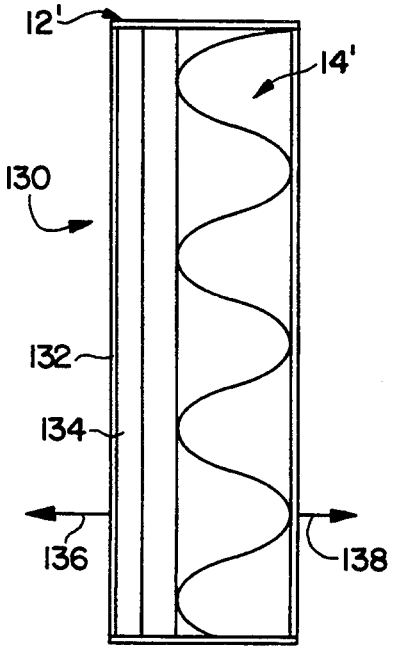
FIG. 16 is a cross-sectional representation of an embodiment of the invention including a frangible element on an exposed surface of the attenuating medium.

Referring to FIG. 16, an attenuating assembly generally similar to that indicated at 10 and 10' elsewhere, is indicated at 130. The assembly 130 includes a confinement means or support medium 12' in combination with a flowable attenuating medium 14'. The attenuating medium may be any of the forms described elsewhere herein.

A frangible element 132 is provided as a protective covering for the assembly 130 and particularly for the attenuating medium 14'. The frangible element 132 is arranged on the blast side or exposed side 136 of the assembly and opposite the protected side 138 of the assembly.

A stiffener 134 is preferably associated with the frangible element 132 if necessary or desired for further support.

This embodiment with the frangible element enables the attenuating assembly to withstand severe outdoor weather environments and to otherwise isolate the environment on one side of the attenuating assembly from the other.

The frangible element 132 is preferably formed as a part of the assembly 130 in order to prevent gas movement or diffusion through or across the assembly 130.

Frangible materials suitable for forming the element 132 are well known to those skilled in the art and may be formed, for example, from scored metal, composites of plastics and glass, plastics, glasses and other polymeric materials. Alternatively, they may also be formed from agglomerations of organic and/or inorganic materials held together by binders and pressed or molded into any desired shape.

The frangible element 132 is preferably designed to withstand wind loads or other common environmental conditions. At the same time, the frangible element 132 is adapted for shattering into small pieces when impinged upon by acoustic level pressure conditions including acoustic waves and/or shock waves as discussed elsewhere herein. Accordingly, when such pressure conditions arise, the shattering of the frangible element 132 immediately exposes the attenuating medium 14' to accomplish its function as described herein.

Still another embodiment of the invention contemplates its use for protecting structures and/or people from the harmful effects of explosive devices including ammunitions, bombs and other types of explosive devices. A particular type of ammunition against which the present invention can provide protection is generally referred to as either a shaped-charge or hollow-charge device. By a combination of substantially reducing the velocity of the shock wave created by the detonation of the shaped-charge development of the blast front which forms a penetrating metal slug and entrainment by the attenuating medium, the penetrating ability of the slug formed by the shaped-charge munition or device is greatly reduced.

Such shaped-charge devices and their use are well known to those skilled in the art and a detailed description of such devices is not believed necessary within the scope of the present invention. It is noted that such shaped-charges and their functions are described by a large number of references, such as the publication *Fundamentals of Shaped-Charges* by William P. Walters, published 1989 by John Wiley & Sons, Inc. (see pp. 13–14, et al.). This reference is also incorporated herein as though set forth in its entirety.

Figure 17:
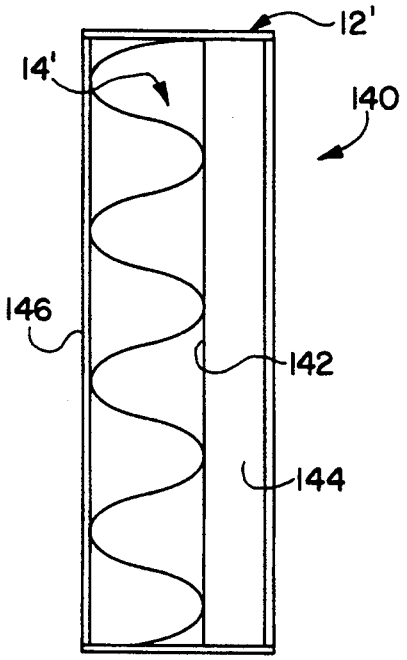
FIG. 17 is a cross-sectional representation of still another embodiment of the invention illustrating its use in combination with armor plate or the like particularly for enhancing the ability of the armor plate to resist explosive devices such as shaped-charge devices.

The use of the present invention in such applications is illustrated in FIG. 17. Referring to FIG. 17, an attenuating assembly is generally indicated at 140 including a confinement means or support medium 12' in combination with a flowable attenuating medium 14' as described elsewhere herein.

In the embodiment of FIG. 17, the attenuating assembly 140 is arranged upon an otherwise exposed surface 142 of typical armor plate generally indicated at 144.

The attenuating assembly 140 preferably and optionally includes an actuating element or support surface 146 arranged either within or opposite the attenuating medium 14' from the exposed surface 142 of the armor plate.

When used to protect against the penetration and subsequent harmful effects from shaped-charge munitions, the assembly 140 can be used as an exterior armor or barrier element for a wide variety of implements or structures (not shown) including armor plate such as that indicated at 144 in FIG. 17. The incorporation of combustion-extinguishing agents, particularly those with rapid reaction times, greatly interferes with the formation of an effective penetrating slug, as shaped-charge munitions are intended to produce, and further reduces the damage possible behind the armor or barrier should it be pierced, particularly due to hot spall and blast gasses under pressure.

These mitigating events are produced by reducing the velocity of the shock wave which forms the penetrating slug, dispersing and scattering elements of the shock wave so as to disrupt the uniform shape of the shock wave front, to suppress to a substantial degree the evolution of blast gasses which constitute the motive force of the slug, and the subsequently formed jet to entrain materials of low mass into the slug and thus accelerate the disruption of the jet's mechanical integrity, and to suppress to a substantial degree the thermal energy component which comprises a substantial portion of the deleterious effects generated by the shaped-charge munition. Incorporation of a low-boiling point or flashing liquid within the attenuating assembly is possible with the present invention, which can further accelerate disruption of the slug as vapor bubbles are entrained.

Accordingly, it is particularly contemplated that this embodiment of the invention be employed in military or terrorist applications or the like.

Shaped-charges of the type referred to above generally fit the definition of the present invention in exceeding sonic or shock wave speeds.

Generally, the present invention can be useful against shaped-charges including only the attenuating medium 14' in combination with the armor plate as illustrated in FIG. 17. In such a combination, the shaped-charge may or may not be actuated upon contact with the medium 14' itself. In any event, the shaped-charge device is detonated upon contact with the exposed surface 142 of the armor plate 144. Assuming actuation upon contact with the armor plate, the shaped-charge device is generally surrounded by the attenuating medium 14' upon detonation so that the attenuating medium interferes with proper operation of the shaped charge as described above.

It is also possible to employ the attenuating medium 14' together with the actuating element or surface 146 which may form a portion of the confinement means or support medium 12'. In this regard, the actuating element 146 is selected with sufficient mass or resistance in order to assure actuation of the shaped-charge device. Thus, with the actuating element 146 in place, actuation of the shaped-charge device is assured as it approaches the attenuating medium 14' prior to engagement with the armor plate 144.

It is to be noted that shaped-charge devices of the type described above may include sequential charges. The embodiment of FIG. 17 with the actuating element 146 may be desirable in connection with such devices since an initial smaller charge would be actuated by the actuating element 146. Thereafter, the main charge of the device would be actuated upon engagement with the armor plate with the device being surrounded by the actuating medium as described above. It is further contemplated that spaced apart layers of the attenuating medium, either alone or in combination with suitable support structure (not shown) may be employed for even further protection against shaped-charge devices including sequential charges.

Another embodiment or concept of the invention is similarly contemplated for protecting people and/or structures from the harmful effects of explosions where explosive ammunitions or devices, for example, may be detonated due to shock wave over-pressure and/or thermal energy release from the detonation of another explosive charge or device. This phenomenon is commonly referred to as "sympathetic detonation", "fratricide", "propagation" or "chain reaction". Any of the embodiments of the present invention may be employed in such applications as a barrier, buffer or ramp of one explosive munition or device in order to protect it from external overpressure and/or thermal energy generated by another explosive device arranged external of the invention.

Accordingly, in this embodiment or concept, the attenuating medium is used in generally the same manner described elsewhere herein. However, it is contemplated that one explosive element or device (not shown) be sheltered or arranged within the attenuating medium assembly of the invention in order to protect it from another explosive element or device (not shown) which is external to the attenuating medium assembly.

A still further embodiment or variation of the invention involves its use in forming air cargo containers or the like. Here again, generally all of the above described embodiments of the invention are suitable for this application with the air cargo container forming the interior of the attenuating medium assembly. Preferably, the assembly is formed as a complete enclosure or lining for the container. It is also particularly contemplated that the invention be used in fabricated panels to form the lining for such containers.

In any event, a container including such a lining can provide substantial protection against blasts occurring within the container, the invention thereby protecting the areas surrounding the container. Similarly, the lining could also protect the interior of the container from external blasts.

Figure 18:
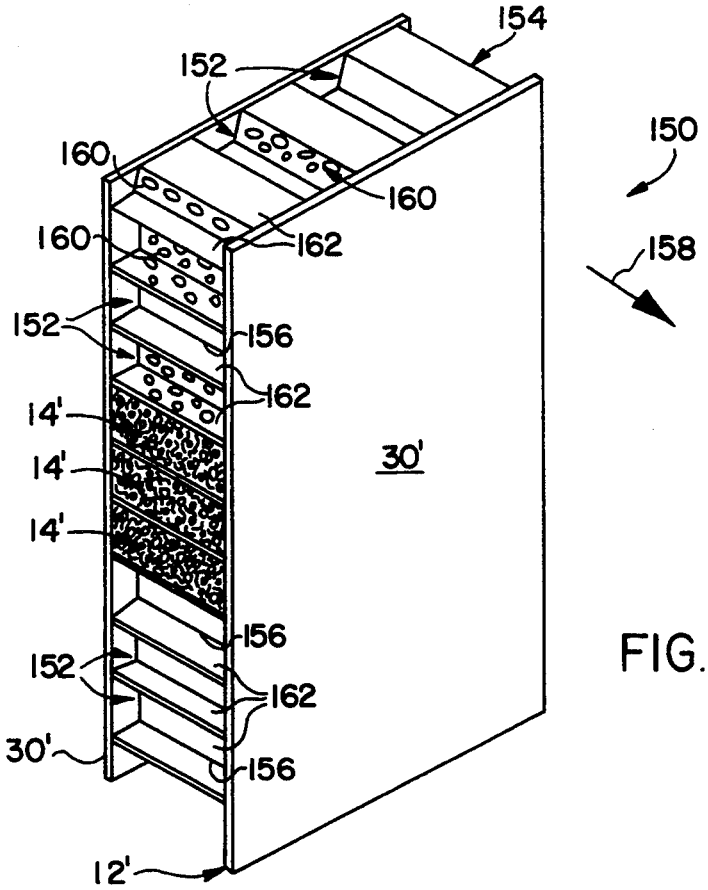
FIG. 18 is a perspective representation of another embodiment wherein the attenuating medium is arranged in the cells of a honeycomb structure.

Referring particularly to FIG. 18, the invention also contemplates use of the attenuating medium of any of the preceding embodiments in combination with conventional honeycomb which may preferably provide support for the attenuating medium. A preferred configuration is indicated at 150 in FIG. 8 wherein the attenuating medium 14' is preferably arranged in all of the cells 152 of a honeycomb structure 154. The attenuating medium is illustrated only in selected cells of the honeycomb structure in FIG. 18 for simplicity.

The attenuating medium may be a solid or liquid as described elsewhere above.

Preferably, the configuration 150 includes porous confinement means 30' arranged on opposite sides of the honeycomb structure 154. The cells 152 of the honeycomb structure are arranged with their axes 156 intersecting the porous confinement means 30'. The configuration 150 is preferably arranged with one of the porous confinement means 30' facing a shock wave source as indicated by the arrow 158.

With this arrangement, the cells of the honeycomb are exposed to the shock wave as it penetrates porous confinement means 30' Thus, the attenuating medium is free to react in generally the same manner described above. Preferably, the cells of the honeycomb are sufficiently large to permit the contemplated function of the attenuating medium.

More preferably, the honeycomb structure 154 is provided with a large number of openings 160 in the walls 162 of the cells. The openings 160 permit lateral propagation of the shock wave between adjacent cells to further facilitate the function of the attenuating medium as discussed elsewhere herein.

There have accordingly been described a number of embodiments of attenuating assemblies and/or mediums constructed according to the present invention. Variations and modifications in addition to those described above are believed obvious from the description. Accordingly, the scope of the invention is defined only by the following appended claims which are also further exemplary of the invention.

What is claimed is:

1. An assembly for attenuating acoustic level pressure conditions, comprising a flowable attenuating medium exhibiting aqueous foam characteristics, namely the ability of acting in the nature of a liquid mass to resist relative displacement by surface tension and viscous forces and the ability to substantially scatter and disperse pressure conditions transmitting therethrough by virtue of multitudinous curved surfaces dividing different phases, and enabling the generation of turbulent flow fields by transmitting pressure conditions, and confinement means for containing and Supporting the flowable attenuating medium, the combination of the confinement means and flowable attenuating medium being arranged for intercepting the pressure conditions to be attenuated, the confinement means being porous with respect to the pressure conditions for allowing the pressure conditions to penetrate the flowable attenuating medium, the porous confinement means also causing substantial pressure decrease of pressure conditions penetrating the porous confinement means, the confinement means comprising generally parallel side portions combining to form a panel with the flowable attenuating medium being supported therebetween for intercepting pressure conditions approaching one of the side portions.

2. The attenuating assembly of claim 1 wherein both side portions of the confinement means are porous with respect to the pressure conditions in order to achieve more effective attenuation thereof.

3. The attenuating assembly of claim 2 further comprising a plurality of panels each formed by generally parallel side portions with the flowable attenuating medium being supported therebetween, and intervening gaps between the panels whereby the pressure conditions are effectively caused to successively penetrate the plurality of panels and intervening gaps in order to achieve even more effective attenuation.

4. The attenuating assembly of claim 3 further comprising structural means for supporting the combination of the confinement means and the flowable attenuating medium.

5. The attenuating assembly of claim 4 wherein the combination of the confinement means and the flowable attenuating medium is shaped to form a generally enclosed chamber.

6. The attenuating assembly of claim 1 wherein the flowable attenuating medium is an aerogel.

7. The attenuating assembly of claim 1 arranged on an exposed surface of armor plate in order to enhance the ability of the armor plate to resist explosive devices.

8. The attenuating assembly of claim 7 wherein the assembly further comprises an element arranged in spaced apart relation from the armor plate for actuating shaped-charge devices approaching the attenuating assembly.

9. The attenuating assembly of claim 1 further comprising a frangible shield associated with the flowable attenuating medium for normally separating environmental conditions on opposite sides of the attenuating medium, the frangible shield being subject to shattering by the acoustic level pressure conditions in order to facilitate reaction of the flowable attenuating medium to the pressure conditions.

10. The attenuating assembly of claim 9 further comprising a stiffener element arranged in supporting relation with the frangible shield.

11. The attenuating assembly of claim 1 forming a lining for at least one surface portion of a container.

12. The attenuating assembly of claim 1 wherein the flowable attenuating medium is an aqueous foam.

13. The attenuating assembly of claim 12 further comprising means for regenerating aqueous foam from liquid draining from the aqueous foam in the confinement means and thereby maintaining the aqueous foam so that its volume substantially fills the confinement means.

14. An assembly for attenuating acoustic level pressure conditions, comprising a flowable attenuating medium exhibiting aqueous foam characteristics, namely the ability of acting in the nature of a liquid mass to resist relative displacement by surface tension and viscous forces and the ability to substantially scatter and disperse pressure conditions transmitting therethrough by virtue of multitudinous curved surfaces dividing different phases, and enabling the generation of turbulent flow fields by transmitting pressure conditions, and confinement means for containing and supporting the flowable attenuating medium, the combination of the confinement means and flowable attenuating medium being arranged for intercepting the pressure conditions to be attenuated, the confinement means being porous with respect to the pressure conditions for allowing the pressure conditions to penetrate the flowable attenuating medium, the porous confinement means also causing substantial pressure decrease of pressure conditions penetrating the porous confinement means, the attenuating medium being arranged in a honeycomb structure.

15. The attenuating assembly of claim 14 wherein the honeycomb is formed with cells having axes arranged for flow of the acoustic level pressure conditions through the cells of the honeycomb.

16. The attenuating assembly of claim 15 wherein the cells are formed by walls having openings interconnecting adjacent cells of the honeycomb.

17. An attenuating panel for attenuating acoustic level pressure conditions, comprising multitudinous solid particulates having a dimension of at least about 1 millimeter, and filamentary material forming a matrix for the solid particulates, the filamentary material having mechanical integrity for providing confinement of the solid particulates in the matrix of filamentary material while allowing the solid particulates to be relatively displaced by interaction with the pressure conditions whereby the panel is capable of scattering and dispersing pressure conditions passing therethrough and further enabling formation of turbulent flow fields within the attenuating panel from the pressure conditions.

18. The attenuating panel of claim 17 further comprising means interacting with the solid particulates and filamentary material to increase resistance of the solid particulates to relative displacement by the pressure conditions in addition to resistance attributable to inertia forces, the attenuating panel being porous throughout a dimension corresponding to passage of the pressure conditions therethrough.

19. The attenuating panel of claim 18 wherein the means interacting between the solid particulates and the filamentary material is an adhesive substance.

20. The attenuating panel of claim 17 wherein the solid particulates comprise an entrained gaseous phase.

21. The attenuating panel of claim 17 wherein the solid particulates are mechanically trapped by multiple strands of the filamentary material.

22. The attenuating panel of claim 17 wherein the solid particulates are more densely distributed in selected regions of the attenuating panel.

23. The attenuating panel of claim 17 wherein the multitudinous solid particulates are integrally formed with the filamentary materials.

24. The attenuating panel of claim 23 wherein the solid particulates each generally have a dimension of at least about 1 millimeter.

25. The attenuating panel of claim 17 further comprising one or more additional and similar attenuating panels in generally parallel arrangement with each other and forming intervening spaces.

26. The attenuating panel of claim 17 arranged to form an enclosed chamber.

27. The attenuating panel of claim 17 forming a lining for at least one surface portion of a container.

28. The attenuating panel of claim 17 arranged on an exposed surface of armor plate in order to enhance the ability of the armor plate to resist explosive devices.

29. The attenuating assembly of claim 28 wherein the assembly further comprises an element arranged in spaced apart relation from the armor plate for actuating shaped-charge devices approaching the attenuating assembly.

30. The attenuating panel of claim 17 further comprising a frangible shield associated with the flowable attenuating medium for normally separating environmental conditions on opposite sides of the attenuating medium, the frangible shield being subject to shattering by the acoustic level pressure conditions in order to facilitate reaction of the flowable attenuating medium to the pressure conditions.

31. The attenuating panel of claim 30 further comprising a stiffener element arranged in supporting relation with the frangible shield.

* * * * *